United States Patent [19]

Bolton et al.

[11] Patent Number: 4,489,872

[45] Date of Patent: Dec. 25, 1984

[54] APPARATUS FOR PRODUCING A LOOP WITHIN A METAL STRIP

[75] Inventors: David R. Bolton; Charles A. Koverman; Marvin L. Neargarder, all of Piqua, Ohio

[73] Assignee: Perfecto Industries, Inc., Piqua, Ohio

[21] Appl. No.: 406,355

[22] Filed: Aug. 9, 1982

[51] Int. Cl.[3] ..... B65H 17/42; B65H 23/32

[52] U.S. Cl. ..... 226/117; 226/118; 226/199

[58] Field of Search ..... 226/118, 113, 114, 196, 226/199, 93, 24, 42, 1, 4, 117; 242/76, 182, 183; 198/679, 805; 335/209, 284; 118/620, 33; 271/193, DIG. 3

[56] References Cited

U.S. PATENT DOCUMENTS

| | | | |
|---|---|---|---|
| 1,706,741 | 3/1929 | Pugh | 226/93 X |
| 2,025,418 | 12/1935 | Moore | 226/118 X |
| 2,731,212 | 1/1956 | Baker | 226/93 X |
| 3,177,749 | 4/1965 | Best et al. | 226/42 X |
| 3,240,411 | 3/1966 | Zarleng | 226/42 |
| 3,661,116 | 5/1972 | Moskowitz et al. | 226/93 X |
| 3,784,071 | 1/1974 | Milan | 226/93 X |
| 3,784,072 | 1/1974 | Armstrong et al. | 226/93 X |
| 3,814,243 | 6/1974 | Miller | 271/193 X |
| 3,888,400 | 6/1975 | Wiig | 226/118 X |

*Primary Examiner*—Philip R. Coe
*Assistant Examiner*—Scott J. Haugland
*Attorney, Agent, or Firm*—Jacox & Meckstroth

[57] ABSTRACT

A ferrous metal strip is fed longitudinally by a set of power driven feed rolls, and a loop portion of the strip is magnetically suspended between two vertically spaced pairs of horizontally opposing magnetic bars or magnets positioned on an incline. The opposing magnets of each pair are spaced slightly greater than the width of the strip, and all of the magnets are laterally adjustable in unison with respect to a vertical center plane for accommodating strips of different widths. A curved strip guide member directs the strip from the feed rolls between the lower pair of opposing magnets and is movable to a retracted position for initially directing the strip from the feed rolls to an incremental stock feeder for a strip cutting or forming machine.

19 Claims, 4 Drawing Figures

APPARATUS FOR PRODUCING A LOOP WITHIN A METAL STRIP

BACKGROUND OF THE INVENTION

In the field of feeding a strip of ferrous metal from a supply coil to a reciprocating press which may cut or deform the strip at progressive intervals, it is common to feed the strip from the supply coil through a strip straightening device or rolls which are continuously driven. After the strip is straightened, it is fed in a step-by-step manner or incrementally by a stock feeder to the reciprocating press. Usually, an accumulation loop is formed within the strip between the continuously operating strip straightening rolls and the incremental stock feeder to accommodate the difference in strip feed rates.

For example, U.S. Pat. No. 2,025,418 discloses a loop forming device which incorporates a series of rollers for guiding or directing a continuously feeding strip along a path to form a U-shaped loop. Similarly, U.S. Pat. No. 3,888,400 discloses a series of guide rollers which direct the strip into a U-shaped accumulation or storage loop. In the loop forming devices disclosed in each of these patents, the leading end of the strip must be threaded or fed through the device, and the strip guide rollers must be properly lubricated or maintained so that no significant dragging or restraining force is applied to the strip as it is fed longitudinally through the device.

Another type of loop forming device is disclosed in U.S. Pat. No. 3,784,071 wherein an accumulation loop is formed within a strip between the opposing runs of two endless belt conveyors. A set of magnets are used to hold the strip against the conveyor belts to avoid slippage of the strip relative to the belts which are independently driven by variable speed motors. While this structure avoids the necessity for feeding or threading the leading end of the strip through the loop forming device, the structure is relatively complex and expensive in construction when compared to the loop forming devices incorporating strip guide rollers.

SUMMARY OF THE INVENTION

The present invention is directed to improved apparatus which is ideally suited for producing a U-shaped loop within a ferrous metal strip after it is fed from a supply coil through a strip straightening device and for directing the strip into an incremental stock feeder for a reciprocating press. The loop forming apparatus of the invention is relatively simple and economical in construction and provides for conveniently forming a loop within the strip after the leading end of the strip is fed into the stock feeder. The apparatus of the invention also eliminates any marking of the strip and conveniently accommodates strips of different widths while maintaining each strip centered relative to a center plane of the stock feeder.

In one embodiment of the invention, the above features and advantages are provided by apparatus which includes a first pair of permanent magnetic bars or elongated magnets arranged in horizontally spaced opposing relation and located below a second pair of elongated magnets arranged in horizontally spaced opposing relation. Both pairs of magnets are positioned on an incline and are adapted to receive and suspend a loop of the metal strip with the spacing between each pair of magnets being slightly greater than the width of the strip. Both pairs of magnets are laterally adjustable in unison for accommodating strips of different widths, and a curved strip guide member is used to direct the strip from a set of straightening rolls into a path between the opposing magnets. The guide member is retractable to simplify initial feeding of the strip from the straightening rolls to a stock feeder after which the curved guide member is positioned to form the U-shaped loop within the strip.

Other features and advantages of the invention will be apparent from the following description, the accompanying drawing and the appended claims.

DESCRIPTION OF THE PREFERRED EMBODIMENT

Figure 1:
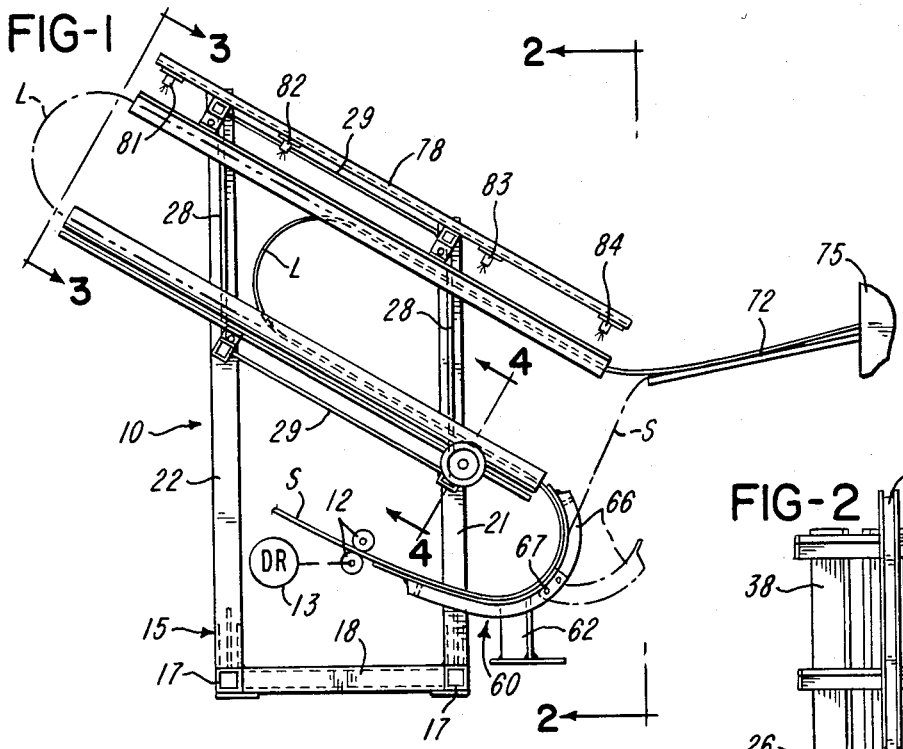
FIG. 1 is a side elevational view of loop producing apparatus constructed in accordance with the invention.

FIG. 1 illustrates loop forming apparatus or device 10 which receives a ferrous metal strip S from a supply coil (not shown) supported by an unwinding reel, and the strip S is directed through a set of straightening rolls which are diagrammatically illustrated by a pair of feed rolls 12 and driven by a variable speed drive motor 13. The loop forming device 10 includes a fabricated steel frame 15 which includes a pair of horizontal base members 17 rigidly connected by a cross-member 18 and supporting a set of vertical posts or upright members 21 and 22. The vertical members 21 and 22 are reinforced by corner plates 23 which are also welded to the base members 17. A set of four support members or arms 26 project horizontally in a cantilevered manner from the vertical members 21 and 22 and are rigidly connected by a set of plates 28 and 29 which form a parallelogram arrangement.

Each set of lower arms 26 supports a pair of elongated permanent magnetic bars 34 and 36, and each pair of upper arms 26 supports a corresponding pair of permanent magnetic bars 34 and 36. Each of the magnetic bars 34 and 36 is constructed of longitudinally aligned rectangular bar segments or blocks. The pairs of magnetic bars are positioned on an incline in vertical spaced relation (FIG. 1), and each pair of magnetic bars is supported with respect to each post 21 and 22 by a pair of angle brackets 38 mounted on a set of support blocks 39 and 41. Each of the blocks 39 and 41 is provided with a threaded hole and receives a correspondingly threaded end portion of an adjustment screw 44. As shown in FIG. 4, each adjustment screw 44 is supported for rotation by a set of bearing blocks 46 and 48 which are secured to the corresponding arm 26, and the center portion of each screw 44 is supported by another bearing block 49 also mounted on the corresponding arm 26. Each of the adjustment screws 44 has one end portion with right hand threads and the opposite end portion with left hand threads so that simultaneous rotation of each pair of screws 44 is effective to shift the corresponding pair of magnetic bars 34 and 36 horizontally or laterally with respect to a vertical center plane P (FIG. 3).

As shown in FIGS. 1 and 4, the lowermost adjustment screw 44 has an outer end portion which receives an adjustment knob or wheel 54. A set of sprockets 57 are mounted on the inner end portions of the lower adjustment screws 44 and are connected by endless chains (not shown) to sprockets on the upper screws so that rotation of the lowermost screw 44 by the hand wheel 54 is effective to rotate all of the screws 44 in unison to vary the spacing between each pair of upper and lower magnetic bars 34 and 36. Each of the magnetic bars or magnets is magnetized through its width, and each pair of magnets are arranged so that the strip is substantially centered with respect to the width of the magnet.

Figure 2:
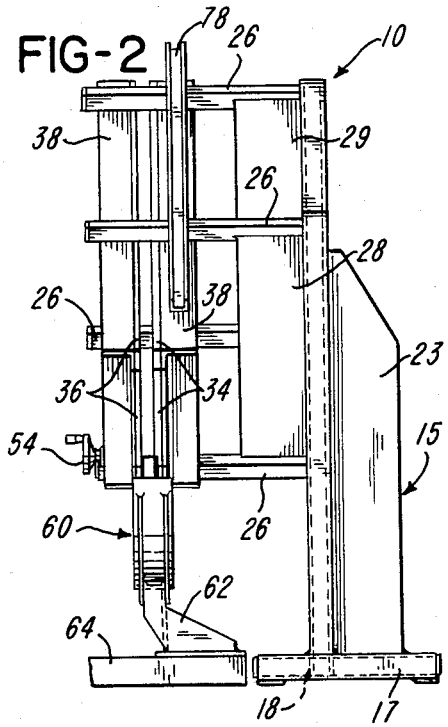
FIG. 2 is an elevational view of the apparatus taken generally on the line 2—2 of FIG. 1.
Figure 3:
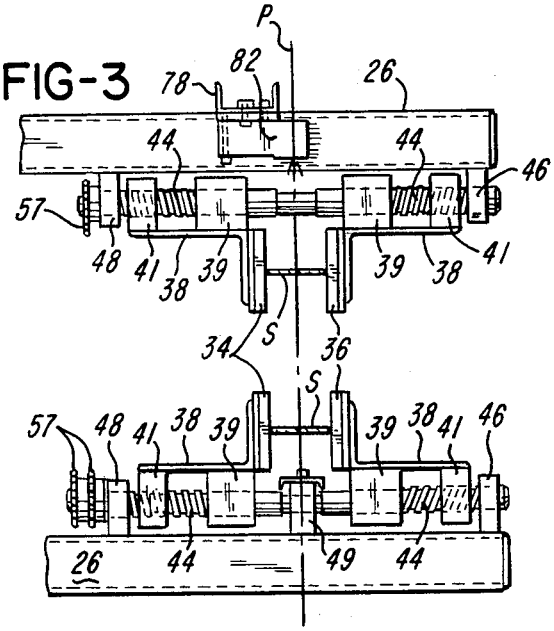
FIG. 3 is a view of the apparatus as taken generally on the line 3—3 of FIG. 1.
Figure 4:
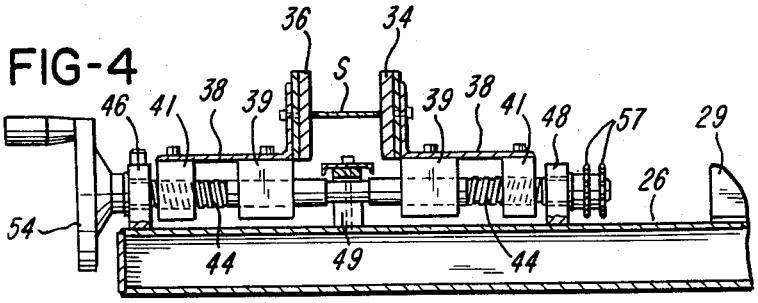
FIG. 4 is a fragmentary section taken generally on the line 4—4 of FIG. 1.

As illustrated in FIG. 3, the spacing between each pair of magnets is adjusted or selected so that the spacing is slightly greater than the width of the ferrous metal strip S received between each pair of magnets. As shown in FIG. 1, the strip S is fed by the feed rolls 12 downwardly on an incline and into a curved strip deflector or guide member 60 mounted on a support stand 62 secured to a base member 64 (FIG. 2). The strip guide member includes a curved guide section 66 which is pivotable on a hinge pin 67 between a deflecting position, as shown in full lines in FIG. 1, to a retracted position, as shown by the dotted lines in FIG. 1.

In a typical installation and application for the loop forming apparatus of the invention, the leading end of the metal strips is directed from the feed rolls 12 and into the strip deflector 60 after the section 66 is moved to its retracted position. The leading end portion of the strip is then fed directly to a stock guide table 72 which extends to an incremental stock or strip feeder 75. The stock feeder is effective to feed the strip in an incremental or step-by-step manner to a reciprocating press (not shown). After the strip is initially fed into the stock feeder 75, the strip deflector section 66 is pivoted to its full line position where continuous longitudinal advancement of the strip by the feed rolls 12 is effective to produce a loop L within the strip S, and the loop L is supported or suspended by the upper and lower pairs of permanent magnets 34 and 36.

As shown in FIGS. 1 and 3, an elongated channel member 78 is mounted on the two upper support arms 26 and supports a series of photooptical strip sensing units 81–84 which are disposed at longitudinally spaced intervals adjacent the upper pair of magnetic bars or magnets 34 and 36. As the loop L within the strip S increases in length between the magnetic bars 34 and 36, the curved end of the loop L within the strip S is sensed by the unit 81 which is connected for automatically starting the stock feeder 75 and the mechanical press. During normal operation of the stock feeder 75 and the mechanical press, the end of the loop L moves between the optical sensing units 82 and 83. When the unit 82 senses the end of the loop L, the unit 82 actuates the control system which slows down the drive motor 13 for the continuously operating feed rolls 12. When the unit 83 senses the end of the loop L, the control system speeds up the drive motor 13 for the feed rolls 12. In the event the feed rolls should not operate or the trailing end of the strip S is fed through the feed rolls 12, the loop shortens and the end of the loop L is sensed by the unit 84. The stock feeder 75 and the reciprocating press are then automatically stopped by the control system.

From the drawing and the above description, it is apparent that a loop forming and supporting device or apparatus constructed in accordance with the invention, provides desirable features and advantages. As one primary advantage, the support of the loop L within the strip S by the upper and lower pairs of permanent magnetic bars or magnets 34 and 36 enables the loop to be easily and quickly formed after the leading end portion of the strip is fed directly from the feed rolls 12 to the stock feeder 75. This eliminates the need for feeding or threading the leading end of each strip through a series of loop forming rollers, as disclosed in the prior art patents mentioned above.

The support of the elongated permanent magnets also provides for conveniently accommodating strips of different widths with each strip remaining centered with respect to the center plane P for the stock feeder 75 and mechanical press. The magnetic bar support for the strip S also prevents any marking or marring of the strip and supports the strip with a low restraining force so that the incremental stock feeder 75 may feed the strip in precise increments into the press.

While the form of apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. Apparatus for producing a U-shaped loop within a flexible sheet metal strip having a predetermined width and adapted to be located between a continuously operating strip straightening device and an incremental strip feeding device, said apparatus comprising a first pair of elongated magnets positioned in substantially parallel horizontally spaced opposing relation, a second pair of elongated magnets positioned in substantially parallel horizontally spaced opposing relation, said first and second pairs of magnets being arranged to receive a U-shaped loop within the strip with each pair of magnets being spaced slightly greater than the width of the strip and adjacent opposite longitudinal edges of the strip, said pairs of magnets being effective to support the loop between the magnets and to provide for movement of the strip longitudinally along different U-shaped paths between each said pair of magnets, and means for feeding the strip longitudinally between said magnets.

2. Apparatus for producing a U-shaped loop within a sheet metal strip having a predetermined width and adapted to be located between a continuously operating strip straightening device and an incremental strip feeding device, said apparatus comprising a first pair of elongated magnets positioned in horizontally spaced opposing relation, a second pair of elongated magnets positioned in horizontally spaced opposing relation, a frame supporting said first pair of magnets below said second pair of magnets with each pair of magnets being spaced slightly greater than the width of the strip and adjacent opposite longitudinal edges of the strip, said first and second pairs of magnets being effective to support therebetween a U-shaped loop within the strip and to provide for movement of the strip longitudinally along different U-shaped paths corresponding to the shape of the loop, means for feeding the strip longitudinally between said magnets, and means for adjusting each pair of magnets horizontally for accommodating strips of different widths.

3. Apparatus for producing a U-shaped loop within a flexible sheet metal strip and for maintaining the loop while the strip moves longitudinally, comprising first magnetic means and second magnetic means positioned in horizontally spaced opposing relation, the spacing between said first and second magnetic means being slightly greater than the width of the strip, said first and second magnetic means disposed adjacent the longitudinal edges of the strip and being effective to receive and magnetically support therebetween a U-shaped loop within the strip and to provide for movement of the strip longitudinally along a U-shaped path corresponding to the shape of the loop, and means for feeding the strip longitudinally between said first and second magnetic means.

4. A method of producing a U-shaped loop within a flexible sheet metal strip and adapted to be used between a continuously operating strip straightening device and an incremental strip feeding device, said method comprising the steps of forming a U-shaped loop within the strip, magnetically supporting the loop within the strip with horizontally spaced opposing magnetic elements positioned adjacent opposite longitudinal edges of the strip within the loop with the width of the strip being slightly less than the spacing between the magnetic elements, and feeding the strip longitudinally along a U-shaped path corresponding to the shape of the loop while the weight of the loop is magnetically supported by the elements.

5. Apparatus as defined in claim 1 wherein said second pair of magnets is positioned vertically above said first pair of magnets.

6. Apparatus as defined in claim 1 wherein said first pair of magnets is disposed generally parallel to said second pair of magnets.

7. Apparatus as defined in claim 6 wherein said first and second pairs of magnets are inclined and provide for feeding the loop upwardly on an incline between said first and second pairs of magnets.

8. Apparatus as defined in claim 1 wherein said means for feeding the strip longitudinally comprise a set of feed rollers driven by a variable speed drive and positioned to receive the strip therebetween, and a curved strip guide member for directing the strip from said rollers into a loop between said magnets.

9. Apparatus as defined in claim 8 and including means supporting a portion of said strip guide member for movement to a retracted position to facilitate feeding the leading end of the strip from said feed rollers directly into the incremental strip feeding device before a loop is formed between said magnets.

10. Apparatus as defined in claim 1 wherein each of said magnets is generally flat and disposed substantially in a vertical plane, and including means for simultaneously adjusting each pair of said magnets horizontally with respect to a center plane for accommodating strips of different widths.

11. Apparatus as defined in claim 1 and including a plurality of sensing elements positioned to sense the end of the loop within the strip and connected to control said strip feeding means for normally maintaining the loop within a predetermined range in length.

12. Apparatus as defined in claim 1 wherein said second pair of magnets is positioned vertically above said first pair of magnets, and including a frame supporting said magnets and including a plurality of generally horizontal arms each projecting in a cantilevered manner, an elongated adjustment screw supported for rotation by each of said arms, and means mounted on each said screw and supporting an adjacent pair of said magnets for generally horizontal movement in response to rotation of said screw.

13. Apparatus as defined in claim 12 wherein said first and second pairs of magnets are inclined and are arranged in generally parallel spaced relation.

14. Apparatus as defined in claim 12 wherein said means for feeding the strip longitudinally comprise a set of driven feed rollers positioned to receive the strip therebetween, a curved guide member for directing the strip from said rollers into a loop between said magnets, and means supporting a portion of said guide member for movement to a retracted position to facilitate feeding the leading end of the strip received from said feed rollers directly into the incremental strip feeding device before a loop is formed between said magnets.

15. Apparatus as defined in claim 2 wherein said means for feeding the strip longitudinally comprise a set of feed rollers driven by a variable speed drive and positioned to receive the strip therebetween, and a curved guide member for directing the strip from said rollers into a loop between said magnets.

16. Apparatus as defined in claim 15 and including means supporting a portion of said strip guide member for movement to a retracted position to facilitate feeding the leading end of the strip from said feed rollers directly to the incremental strip feeding device before a loop is formed between said magnets.

17. Apparatus as defined in claim 2 and including a plurality of photo-optical sensing elements positioned to sense the end of the loop within the strip and connected to control said strip feeding means for normally maintaining the loop within a predetermined range in length.

18. A method as defined in claim 4 wherein the loop within the strip is magnetically supported between upper and lower pairs of horizontally spaced opposing elongated magnetic bars.

19. A method as defined in claim 4 and including the step of feeding the leading end of the strip to the incremental strip feeding device before forming the loop and supporting the loop with the magnetic elements.

* * * * *